US011362445B2

(12) United States Patent
Fleischer et al.

(10) Patent No.: US 11,362,445 B2
(45) Date of Patent: Jun. 14, 2022

(54) CONTACT SYSTEM FOR CONTACTING A BRAIDED SHIELD AND A CONTACT ELEMENT

(71) Applicant: GEBAUER & GRILLER KABELWERKE GESELLSCHAFT M.B.H., Vienna (AT)

(72) Inventors: Gottfried Fleischer, Poysdorf (AT); Karl Froeschl, Herrnbaumgarten (AT); Michael Schwent, Mistelbach (AT)

(73) Assignee: GEBAUER & GRILLER KABELWERKE GESELLSCHAFT M.B.H., Vienna (AT)

( * ) Notice: Subject to any disclaimer, the term of this patent is extended or adjusted under 35 U.S.C. 154(b) by 144 days.

(21) Appl. No.: 16/612,013

(22) PCT Filed: Jun. 22, 2017

(86) PCT No.: PCT/EP2017/065459
§ 371 (c)(1),
(2) Date: Nov. 8, 2019

(87) PCT Pub. No.: WO2018/206127
PCT Pub. Date: Nov. 15, 2018

(65) Prior Publication Data

US 2021/0143562 A1 May 13, 2021

(30) Foreign Application Priority Data

May 12, 2017 (EP) ..... 17170864

(51) Int. Cl.
*H01R 4/50* (2006.01)
*H01R 43/00* (2006.01)

(52) U.S. Cl.
CPC ..... *H01R 4/5083* (2013.01); *H01R 4/5016* (2013.01); *H01R 43/00* (2013.01)

(58) Field of Classification Search
CPC ..... H01R 4/5016; H01R 4/5083; H01R 43/00
See application file for complete search history.

(56) References Cited

U.S. PATENT DOCUMENTS 3,245,027 A 4/1966 Ziegler
4,135,776 A * 1/1979 Ailawadhi ..... H01R 9/0521 439/583

(Continued)

FOREIGN PATENT DOCUMENTS

CN 103918129 7/2014
DE 898 018 11/1953

(Continued)

OTHER PUBLICATIONS

China Search Report conducted in counterpart China Appln. No. 201780090394.6 (in English).

(Continued)

*Primary Examiner* — Carl J Arbes
(74) *Attorney, Agent, or Firm* — Greenblum & Bernstein, P.L.C.

(57) ABSTRACT

The invention relates to a contact system for contacting an aluminium braid (7) to a contact element (1) comprising—an electrically conducting cable (4); —the aluminium braid (7) comprising a plurality of aluminium wires, which is arranged to run at least in sections between a primary isolation (6) and a secondary isolation (8) of the electrically conducting cable (4); —die contact element (1) which can be pushed onto the electrically conducting cable (4) having an outer sleeve (3) and an inner sleeve (2) which can be inserted therein. To achieve a contact system which makes possible, in a simple fashion, a reliable contacting of an aluminium braid to a contact element without additional soldering systems being required, according to the invention the inner sleeve (2) has a first contact surface (2*a*) and the outer sleeve (3) has a second contact surface (3*a*), wherein (Continued)

each contact surface (2*a*, 3*a*) has areas of different size of cross-section and the contact surfaces (2*a*, 3*a*) are designed in such a manner that the aluminium braid (7) is clamped in a contact position by the inner sleeve (2) being pushed axially inside the outer sleeve (3) and contact is made with the contact element (1).

19 Claims, 5 Drawing Sheets

(56) References Cited

U.S. PATENT DOCUMENTS

| | | | | |
|---|---|---|---|---|
| 4,408,822 | A * | 10/1983 | Nikitas | H01R 9/0521 439/394 |
| 5,508,475 | A * | 4/1996 | Profiri | F16L 33/2076 174/19 |
| 6,210,222 | B1 * | 4/2001 | Langham | H01R 9/0518 439/578 |
| 6,692,299 | B1 | 2/2004 | Stockmaster | |
| 7,044,756 | B1 * | 5/2006 | Asakura | H01R 9/0512 439/98 |
| 9,160,080 | B2 * | 10/2015 | Lienert | H01B 1/023 |
| 9,306,355 | B2 * | 4/2016 | Hanazaki | H01R 43/048 |
| 9,525,240 | B2 * | 12/2016 | Aue | H01R 9/034 |
| 10,211,547 | B2 * | 2/2019 | Burris | H01R 43/16 |
| 2002/0030329 | A1 * | 3/2002 | Montena | H01R 9/0521 280/1 |
| 2007/0232088 | A1 * | 10/2007 | Burris | H01R 9/0524 439/63 |
| 2008/0248689 | A1 * | 10/2008 | Montena | H01R 9/05 439/583 |
| 2014/0326501 | A1 | 11/2014 | Lienert et al. | |
| 2015/0140864 | A1 | 5/2015 | Aue | |
| 2017/0069982 | A1 | 3/2017 | Burries et al. | |

FOREIGN PATENT DOCUMENTS

| | | | |
|---|---|---|---|
| DE | 1196268 B | * | 7/1965 |
| DE | 2019332 A1 | * | 11/1971 |
| DE | 2445898 C2 | * | 2/1985 |
| DE | 10 2012 00 137 | | 8/2013 |
| EP | 2242147 A1 | * | 10/2010 |
| EP | 2 874 236 | | 5/2015 |
| EP | 3 139 446 | | 3/2017 |
| GB | 931509 | * | 7/1963 |
| GB | 2106724 B | * | 4/1983 |

OTHER PUBLICATIONS

China Office Action conducted in counterpart China Appln. No. 201780090394.6 (dated Dec. 25, 2020).
Int'l Search Report (Form PCT/ISA/210) conducted in Int'l Appln. No. PCT/EP2017/065459 (in English).

* cited by examiner

CONTACT SYSTEM FOR CONTACTING A BRAIDED SHIELD AND A CONTACT ELEMENT

FIELD OF THE INVENTION

The invention relates to a contact system for contacting an aluminium braided shield with a contact element, comprising an electrically conductive cable having an inner electrical conductor, a primary insulation surrounding the inner electrical conductor, and a secondary insulation surrounding the primary insulation;

the aluminium braided shield which comprises a plurality of aluminium wires and which is arranged so as to extend at least in part between the primary insulation and the secondary insulation of the electrically conductive cable;

the contact element which can be pushed onto the electrically conductive cable and which comprises an outer sleeve and an inner sleeve that can be pushed at least in part into the outer sleeve.

PRIOR ART

Electrical cables which have inner conductors that carry high voltages require electrical shielding in order to prevent interference from electrical and/or electronic components located in the vicinity. The shielding may also be provided to protect the inner conductor against external electrical and/or magnetic interference. For shielding purposes, a braided shield is provided which consists of a plurality of strands of an electrically conductive material, said braided shield covering the inner electrical conductor. The braided shield is usually located inside a cable sheath and is arranged between a primary insulation, also referred to as the inner sheath, which is arranged between the inner conductor and the braided shield, and a secondary insulation, also referred to as the outer sheath or cable sheath, which externally surrounds the braided shield. In order to increase the shielding effect of the braided shield, a shielding foil, which is usually a plastic-laminated aluminium foil, may additionally be provided either between the primary insulation and the braided shield or between the braided shield and the secondary insulation. This shielding foil does not transmit any significant currents and, when the braided shield is contacted, is not contacted along with the latter but rather is cut off when exposing the braided shield.

In order to ensure the shielding of the inner conductor and the potential equalization of the braided shield, it is necessary that the braided shield can be connected to a ground in the end regions of the electrical cable. For this purpose, usually at least one contact element is provided at each end of the cable, said contact elements being electrically conductively connected to the braided shield and being able to be connected to the ground.

Known methods for connecting a braided shield made of copper to a contact element, as disclosed for example in DE 10 2015 004 485 B4, are usually carried out by pushing a support sleeve onto the secondary insulation of the cable and folding the exposed braided shield back over the support sleeve. The contact part is then guided over the support sleeve and the braided shield resting thereon and is radially compressed, for example crimped, by means of a suitable tool for contacting purposes. As a result of the compression, the braided shield is clamped between the support sleeve and the contact part. These methods can only be used in the case of materials which have good transverse conductivity, since the braided shield is compressed only at points.

Suitable conductive materials for braided shields include aluminium or aluminium alloys, these being used in many fields of application on account of the low weight thereof, for example in the automotive sector, in particular in electrically powered cars. However, when aluminium wires made of aluminium or an aluminium alloy are compressed together, these wires naturally already have an oxide layer on their surface, which is very difficult to penetrate. Due to the radial compression, a contacting process for a braided shield which is customary in copper technology is unable to establish a contacting of all the aluminium wires of the aluminium braided shield with the contact element since the oxide layers which form on the aluminium wires hinder the transverse conductivity in the compressed regions. Using known methods, therefore, it is not possible to penetrate the oxide layers of all the wires in the braided shield. It has also been found that, by using knows contacting methods on aluminium braided shields, it is not possible to achieve a connection that is stable when exposed to changes in temperature.

In order to enable uniform shield contacting in the case of these materials, known connection methods use additional measures for aluminium braided shields in order to reliably contact all the aluminium wires and to be able to break open the oxide layer where necessary. By way of example, it is known from DE 10 2012 00 137 B4 that, when connecting an aluminium braided shield to a sleeve, the braided shield is folded back over the sleeve and the connection is established by means of ultrasonic welding. In said method, a material connection between the braided shield and the contact part is established by supplying heat.

This type of connection technique firstly has the disadvantage that the quality of the shield strand still influences the quality of the connection; in particular, adhering substances from the previous processes cause disruption. Secondly, the establishment of such electrically conductive connections between an aluminium braided shield and a contact element is dependent on the presence of expensive welding systems, which additionally are not portable and therefore are unable to be used flexibly.

OBJECT OF THE INVENTION

It is therefore an object of the invention to overcome the disadvantages of the prior art and to propose a system which easily enables reliable contacting of an aluminium braided shield with a contact element, without additional welding systems being required.

SUMMARY OF THE INVENTION

In a contact system according to the invention for contacting an aluminium braided shield with a contact element of the type mentioned above, this object is achieved in that the inner sleeve has a first contact surface and the outer sleeve has a second contact surface for contacting the aluminium braided shield, wherein the first and/or second contact surface has regions with a differently sized cross-section with respect to a conductor axis of the electrically conductive cable, and wherein the contact surfaces are designed such that the aluminium wires of the aluminium braided shield in a contact position of the contact part are clamped between the contact surfaces and are contacted with the contact part by axially pushing the inner sleeve and the outer sleeve one inside the other.

In the context of the invention, inner electrical conductors made of electrically conductive material, preferably copper, aluminium or alloys containing at least one of these metals, will be understood to mean both single conductors and also strands consisting of a plurality of single conductors, or else a bundle formed of two, three, four or more strands which are covered by the primary insulation. The inner electrical conductor defines a conductor axis which follows the course of the electrical cable, that is to say may in part extend in a straight line or in a curved or angled manner. At least in the region of the contacting, however, the conductor axis generally runs in a straight line.

A sleeve will usually be understood to mean an element which comprises a passage opening, preferably arranged centrally, and a sheath body which has the passage opening and which is preferably rotationally symmetrical. The passage opening may in principle have any geometric cross-section, provided that the passage of at least a portion of the electrically conductive cable is ensured. The inner sleeve is that sleeve which, in the contact position, is arranged closer to the inner conductor in the radial direction. In other words, the inner sleeve can be pushed onto the electrically conductive cable, so that the passage opening of the inner sleeve, hereinafter referred to as the cable bushing, is advantageously matched to the geometry of the inner electrical conductor of the cable, for example circular, elliptical or substantially polygonal. The sheath body of the inner sleeve is designed such that the inner sleeve can be pushed at least in part into the outer sleeve, wherein the first contact surface of the inner sleeve is usually formed by a radially outer circumferential surface of the inner sleeve. The ability to be pushed in is usually achieved in that the external dimensions of the inner sleeve is smaller than or equal to the internal dimensions of the passage opening of the outer sleeve. The second contact surface of the outer sleeve is usually formed by a radially inner circumferential surface, that is to say by the boundary surface of the passage opening of the outer sleeve.

In any case, the contact surfaces are defined by a surface of the inner sleeve and of the outer sleeve and conceptually enclose a volume. When, in the context of the invention, mention is made of a cross-section of a contact surface, this will be understood to mean the cross-section of the enclosed volume, which is oriented normal to the conductor axis.

In the contact position, the aluminium braided shield is arranged between the contact surfaces, so that the aluminium wires of the aluminium braided shield, preferably as far as possible all the aluminium wires, contact both the first contact surface and the second contact surface. Due to the differently sized cross-sections, provided according to the invention, of at least one of the contact surfaces of the inner sleeve and outer sleeve, which are usually arranged in a manner corresponding to one another in the contact position, the aluminium wires of the aluminium braided shield which contact the contact surfaces are already clamped by axially pushing the outer sleeve and the inner sleeve one inside the other. Due to the different cross-sections, in the case of a circular cross-section these correspond to the diameter in different regions of at least one of the cooperating contact surfaces, which regions merge into one another either continuously or with a jump, at least one region is defined in which, when the sleeves are pushed one inside the other, a clamping force which acts on the aluminium braided shield is exerted by the contact surfaces. Preferably, each of the contact surfaces has regions of differently sized cross-section.

Either an electrical contact between the outer sleeve and/or the inner sleeve and the aluminium wires is thus established, so as to enable a potential equalization. With regard to the choice of geometry of the cooperating contact surfaces of the sleeves, a large number of shapes are suitable, provided that the configuration of the contact surfaces and the cross-sections thereof define at least one region by which a clamping force that acts on the aluminium braided shield is exerted when the sleeves are pushed one inside the other.

In the context according to the invention, axially pushing one inside the other and pressing together will be understood to mean that the two sleeves are pushed one inside the other and pressed together in the direction of a conductor axis, and the compression is not achieved by subsequent radial compression, for example crimping, in the manner known from the prior art. Uniform contacting between the aluminium wires and the contact element is thus already achieved by the sleeves being pushed one inside the other, since the compression no longer takes place radially or at points but instead extends uniformly over the contact surface and the aluminium wires.

Although the invention refers to an aluminium braided shield formed of aluminium wires, it is expressly pointed out that the contact element according to the invention is also suitable for braided shields made of other materials or alloys, for example of copper or copper alloys.

In order to easily ensure the contacting between the aluminium wires of the aluminium braided shield and the contact element, in particular in order to be able to reliably penetrate the oxide layer of the aluminium wires, it is provided in one embodiment variant of the invention that the contact surfaces are additionally designed such that, in the contact position of the contact element, by axially pressing the outer sleeve and the inner sleeve together, the aluminium wires of the aluminium braided shield are pinched/sheared and the aluminium wires of the aluminium braided shield are cold-welded to the contact element.

In this embodiment variant, the contacting between the aluminium braided shield and the contact element is therefore achieved in that the contact surfaces of the inner sleeve and outer sleeve are designed such that the surface having the oxide layer on as far as possible all the aluminium wires of the aluminium braided shield is broken open when the inner sleeve and the outer sleeve are axially pressed together, so that a cold welding can take place between at least one contact surface and the aluminium braided shield. In order to break open the surface, the aluminium wires are pinched and/or at least partially sheared/sheared off when the sleeves are pressed together, so that a cold welding occurs between the aluminium wires and at least one of the sleeves, that is to say the inner sleeve and/or the outer sleeve. Due to the regions of different cross-section on the contact surfaces, which preferably correspond to one another, once again at least one region is defined in which a pressure peak forms during the pressing-together. This region is usually the region in which the clamping force is also exerted. A cold-welded state can thus be achieved when the sleeves, for example starting from the contact position in which the aluminium braided shield is clamped between the contact surfaces, are axially pressed together.

The cold welding utilizes the effect that, when a very high pressure is applied, aluminium tends to flow and thus can be cold-welded to contacting materials. Such a connection is non-detachable and electrically conductive.

In other words, choosing the geometry of the cooperating contact surfaces while taking account of the regions of differently sized cross-sections ensures that, when the sleeves are axially pressed together, the oxide layer is reliably broken open by the aluminium wires of the aluminium braided shield being pinched and/or sheared (off) in a region defined by the contact surfaces. At the same time, due to the local shearing/pinching and the cold welding that takes place there, the connection by means of the contact system according to the invention is insensitive to surface contamination of the aluminium braided shield. With regard to the choice of geometry of the cooperating contact surfaces of the sleeves, a large number of shapes are suitable, provided that the configuration of the contact surfaces and of the regions thereof with different cross-section define at least one region in which, when the sleeves are axially pressed together, a pressure peak forms which leads to the pinching/shearing of the aluminium wires and ultimately to the cold welding.

Usually, one of the sleeves is manufactured from copper or a, preferably coated, copper alloy and serves as a contact sleeve, while the other sleeve acts as a support sleeve. Advantageously, the cold welding takes place both between the contact sleeve and the aluminium braided shield and also between the support sleeve and the aluminium braided shield.

In another embodiment variant of the invention, it is provided that the second contact surface of the outer sleeve bounds an insertion volume for the inner sleeve, and the first contact surface of the inner sleeve is formed by an insertable portion of the inner sleeve that can be inserted into the insertion volume. The insertion volume of the outer sleeve is usually formed by a portion of the passage opening, preferably entirely by the passage opening. The cooperation between the contact surfaces can easily be achieved by the shape of the insertion volume of the outer sleeve and of the insertable portion of the inner sleeve.

According to another embodiment variant of the invention, it is provided that the insertion volume and/or the insertable portion taper at least in part with respect to the conductor axis. By tapering at least one, preferably both, of the elements forming the contact surfaces, it is easy to achieve a geometry of the contact surfaces which brings about a clamping and/or a pinching/shearing of the aluminium braided shield in the contact position. The region which exerts a clamping force on the aluminium wires and which brings about a pinching/shearing of the aluminium wires is formed in the tapering portion. It goes without saying that also two, three, four or more tapering portions may be provided. In other words, the contact surfaces may be designed such that, in an intermediate position of the contact part, in which the inner sleeve is pushed at least in part into the outer sleeve, a gap for receiving the aluminium braided shield forms between the contact surfaces and the gap has at least one cross-sectional narrowing.

A particularly space-saving design of the contact element is achieved in one preferred embodiment variant in that the inner sleeve is entirely received in the insertion volume of the outer sleeve in the contact position. In other words, the entire inner sleeve is designed as the insertable portion.

In order to be easily able to produce and define the regions with a differently sized cross-section in the contact surfaces, it is provided in another embodiment variant of the invention that the first and/or the second contact surface are designed to extend at least in part at an angle to the conductor axis in the contact position. In other words, the imaginary extensions of the first and/or second contact surface intersect the conductor axis.

In one preferred embodiment variant, a clamping and/or a compression/shearing-off of the aluminium wires of the aluminium shielded braid between the contact surfaces can be achieved particularly easily in that the first and/or the second contact surface is conical. As a result of the conicity, which is usually in relation to the conductor axis, of the at least one contact surface, preferably of both contact surfaces, the situation is achieved whereby, by axially displacing the sleeves into the contact position, the contact surfaces exert a clamping force on the aluminium wires and/or form a pressure peak for pinching/shearing (i.e. cold welding) the aluminium wires. It goes without saying that the contact surfaces are designed to correspond to one other, at least when both contact surfaces are conical.

In another preferred embodiment variant, an increase in the clamping force and/or a particularly efficient definition of a region an which a cold welding takes place is achieved in that the first and the second contact surface are conical, wherein the opening angle of the cones are at least in part of different size. Due to the different opening angle with respect to the conductor axis, when the sleeves are pushed axially one inside the other there is on the one hand an increase in the clamping force in that region in which the clear distance between the contact surfaces is minimal. On the other hand, a region between the contact surfaces can thus be defined in which a pressure peak forms when the sleeves are pressed together. As a result of this pressure peak, a shearing/pinching of the aluminium wires can be achieved in order to bring about the cold welding.

The effects mentioned above in connection with the conical contact surfaces can be further improved in that the first and/or the second contact surface has at least one kink. Here, a kink will be understood to mean the change in slope in the conical or frustoconical contact surface or, in other words, the continuous transition between two merging portions of the contact surface that have different opening angles. Each kink defines a circumferential contact edge, at which a pressure peak forms and/or which exerts a clamping force on the aluminium braided shield. Advantageous effects are already observed if just one of the contact surfaces has a kink. However, variants are also conceivable in which one contact surface has multiple kinks or both contact surfaces have one or more kinks. The kinks once again define the region in which the clamping force is exerted on the aluminium wires in the contact position or the pressure peak forms in the contact position.

As a further possibility for achieving a clamping and/or a pinching shearing of the aluminium wires of the aluminium braided shield between the contact surfaces of the sleeves, it is provided in one particularly preferred embodiment variant of the invention that the first and/or the second contact surface has at least one step. A step will be understood here to mean a sudden increase or reduction in size of the cross-sectional area, normal to the conductor axis, which defines the corresponding contact surface. Such a configuration may be combined with any geometric shape of the contact surfaces; for example, the first and/or second contact surface may have a cylindrical shape or the above-described conical shape. It is advantageous if the two contact surfaces have first and second steps which correspond to one another. The at least one first and/or second step once again defines the region in which the pressure peak forms in the contact position for exerting the clamping force and/or for pinching/shearing and cold welding the aluminium wires of the aluminium braided shield. Advantageous effects are already observed if just one of the contact surfaces has a step.

However, variants are also conceivable in which one contact surface has multiple steps or both contact surfaces have one or more steps.

In order to amplify the advantages mentioned above in connection with the steps, it is provided according to another particularly preferred embodiment variant of the invention that the first contact surface has at least one first step and the second contact surface has at least one second step, wherein the steps each form a circumferential contact edge and the aluminium braided shield is contacted by the contact edges in the contact position. The contact edges once again define that region in which the pressure peak forms in the contact position for exerting the clamping force and/or for pinching/shearing and cold welding the aluminium wires of the aluminium braided shield.

It is advantageous for potential equalization if one of the sleeves is designed as a contact sleeve, via which the potential equalization is made possible, and the other sleeve is designed as a support sleeve. In order to achieve good connection properties between the aluminium wires of the aluminium braided shield and the contact sleeve, it is particularly advantageous if the contact sleeve is manufactured from copper or a copper alloy. Depending on the field of use, either the inner sleeve or the outer sleeve may be designed as the contact sleeve. It is also conceivable that both the contact sleeve and the support sleeve are manufactured from copper or a copper alloy. It is therefore provided in other embodiment variants of the invention that the inner sleeve and/or the the outer sleeve is manufactured from copper or a copper alloy.

In another embodiment variant, particularly good clamping properties and/or cold-welding properties and electrical conduction properties are achieved in that one of the sleeves is manufactured from copper or a copper alloy, and the respective other sleeve is manufactured from aluminium or an aluminium alloy. The tendency of the aluminium wires to corrode in the region of the contact element is also minimized by the sleeve manufactured from aluminium or an aluminium alloy, that is to say the sleeve designed as the support sleeve. In order to achieve a particularly high strength of the support sleeve, the latter may also be manufactured from stainless steel, which is preferably protected against corrosion, for example by means of a corrosion-inhibiting coating.

In order to improve also the corrosion properties of the sleeve manufactured from copper or a copper alloy, preferably the contact sleeve, and to reduce the tendency of the aluminium wires to corrode, it is provided in another particularly preferred embodiment variant of the invention that the sleeve manufactured from copper or a copper alloy has a corrosion-inhibiting coating. Suitable coating materials for such a corrosion-inhibiting coating are, in particular, nickel and/or tin or alloys containing nickel and/or tin.

In order to be able to contact the aluminium braided shield, which is arranged between the primary insulation and the secondary insulation, with the contact element, it is generally necessary to cut the cable to length and to strip the aluminium braided shield at an open end of the cable, that is to say to remove at least the secondary insulation, and to position the inner sleeve relative to the electrical conductor. It is therefore provided in another embodiment variant of the invention that the secondary insulation is removed at least in that region of the electrically conductive cable in which the contact element is arranged in the contact position, wherein the region having the smallest cross-section of the first contact surface adjoins the region of the cable that has the secondary insulation.

While it is known according to the prior art that the contact element in the contact position is seated on the secondary insulation of the cable and the braided shield is folded back over the contact element so as not to damage the inner conductor by the subsequent radial compression or welding, it is nevertheless possible, by configuring the inner sleeve and the outer sleeve according to the invention, to arrange the contact element in a space-saving manner in the stripped region of the cable, that is to say in that region in which the secondary insulation is removed. The reason for this is that the clamping and/or cold welding is achieved solely by pushing the inner sleeve and the outer sleeve one inside the other and pressing them together, and thus there is no risk that the inner conductor will be damaged by axial compression of the sleeves. Preferably, the inner sleeve is pushed in between the primary insulation and the aluminium braided shield, so that the inner sleeve contacts the primary insulation on one side and the aluminium braided shield on the other side. It is therefore provided in another preferred embodiment variant of the invention that the inner sleeve in the contact position is arranged between the primary insulation and the aluminium braided shield, wherein preferably a cable bushing of the inner sleeve contacts the primary insulation. Both the inner sleeve and the outer sleeve, or at least the contact surfaces thereof, are thus located in the stripped region of the cable in the radial direction.

In another embodiment variant of the invention, it is provided that the aluminium braided shield is folded over the first contact surface of the inner sleeve and a cable bushing of the inner sleeve contacts the secondary insulation or the aluminium braided shield. If the inner sleeve in the contact position is seated on the secondary insulation and thus the cable bushing, that is to say the passage opening, of the inner sleeve contacts the secondary insulation, the aluminium braided shield must be folded over the first contact surface for contacting purposes. One particularly space-saving construction is achieved in that the inner sleeve is pushed over the aluminium braided shield in the stripped region of the cable and then the aluminium braided shield is folded over the first contact surface. In doing so, the cable bushing contacts the portion of the aluminium braided shield that bears against the primary insulation, and the first contact surface contacts the folded-back part of the aluminium braided shield.

The object mentioned in the introduction is also achieved by a method for contacting an aluminium braided shield and a contact element, the aluminium braided shield being formed of aluminium wires and surrounding an inner electrical conductor of an electrically conductive cable, wherein the contact element comprises an inner sleeve having a first contact surface and an outer sleeve having a second contact surface, wherein the following steps are carried out:

- if necessary, removing a portion of a secondary insulation surrounding the aluminium braided shield and/or a portion of a primary insulation surrounding the inner conductor in the region of an open end of the electrical cable;
- if necessary, pushing the inner sleeve and the outer sleeve onto the electrically conductive cable;
- placing the inner sleeve between the aluminium braided shield and the inner conductor, wherein the aluminium braided shield bears against the first contact surface;
- displacing the outer sleeve in the direction of the inner sleeve into a contact position of the contact part in which the second contact surface of the outer sleeve contacts the aluminium braided shield and the aluminium wires of the aluminium braided shield is securely clamped between the contact surfaces.

First, the electrically conductive cable is cut to length and a resulting open end of the cable is stripped, wherein, during the stripping, at least the secondary insulation is removed in or up to that region in which the contacting with the contact element is to be established. It goes without saving that use can also be made of a cable which has already been cut to length and which has a stripped open end.

Then, the inner sleeve and the outer sleeve are pushed onto the cable, wherein the cable is passed through the passage opening of the sleeves, respectively the insertion volume and the cable bushing. However, it is also conceivable that the electrical cable is delivered in an already prefabricated form, so that the outer sleeve and the inner sleeve need only be further pushed together and pressed together.

If the contact element in the contact position is to be arranged in the non-stripped region of the cable, it is necessary first to push the inner sleeve onto the secondary insulation, then to fold the aluminium braided shield over the secondary insulation and over the inner sleeve, and thereafter to push the outer sleeve from the direction of the stripped region of the cable in the direction of the inner sleeve. In other words, the inner sleeve is placed between the secondary insulation and the folded-back portion of the aluminium braided shield. It is therefore provided according to another embodiment variant of the invention that first the inner sleeve is pushed over the secondary insulation and then the aluminium braided shield is folded over the first contact surface, before the outer sleeve is displaced in the direction of the inner sleeve. In this case, the outer sleeve is displaced from the direction of the open end of the cable in the direction of the region of the electrically conductive cable that has the secondary insulation, so as to be brought into the contact position.

If, however, the contact element in the contact position is to be arranged in a space-saving manner in the stripped region of the cable, as provided in one preferred embodiment variant of the invention, then first the outer sleeve is pushed onto the secondary insulation of the cable. The inner sleeve is then pushed in between the primary insulation and the aluminium braided shield, so that there is no longer any need for the aluminium braided shield to be folded over. Thereafter, the outer sleeve is then pushed in the direction of the stripped region of the cable and in the direction of the inner sleeve. It is therefore provided according to another embodiment variant of the invention that first the outer sleeve is pushed over the secondary insulation and then the inner sleeve is pushed in between the aluminium braided shield and the primary insulation, before the outer sleeve is displaced in the direction of the inner sleeve. In this case, the outer sleeve is displaced from the region of the electrical cable having the secondary insulation in the direction of the open end of the cable, so as to be brought into the contact position.

It is particularly space-saving if the inner sleeve in the stripped region is pushed directly onto the aluminium braided shield bearing against the primary insulation, and the aluminium braided shield in the stripped region of the electrically conductive cable is folded over the first contact surface. In this case, the aluminium braided shield is exposed to such an extent that a portion projects beyond the inner sleeve that has been pushed on, and can be folded over the latter. Thereafter, the outer sleeve is then displaced in the direction of the region of the electrically conductive cable having the secondary insulation. It is therefore provided according to another embodiment variant of the invention that first the inner sleeve is pushed over the aluminium braided shield and then a portion of the aluminium braided shield that projects beyond the inner sleeve is folded over the first contact surface, before the outer sleeve is displaced in the direction of the inner sleeve. In this case, the outer sleeve is displaced from the direction of the open end of the cable in the direction of the region of the electrically conductive cable having the secondary insulation, so as to be brought into the contact position.

In any case, in all the variants mentioned above, the inner sleeve is placed between the inner conductor and the braided shield, as seen in the radial direction, optionally with the interposition of the primary insulation and/or the secondary insulation.

By pushing the outer sleeve and the inner sleeve one inside the other, the aluminium wires of the aluminium braided shield are securely clamped between the contact surface, as described in detail above in connection with the contact system.

In order to easily ensure the contacting between the aluminium wires of the aluminium braided shield and the contact element, in particular in order to be able to reliably penetrate the oxide layer of the aluminium wires, it is provided in one embodiment variant of the method according to the invention that the following method step is additionally carried out:

pushing and pressing the outer sleeve further in the direction of the inner sleeve so that, as a result of the pressure applied by the contact surfaces, a pinching/shearing of the aluminium wires of the aluminium braided shield and a cold welding of the aluminium wires of the aluminium braided shield to the contact surfaces of the contact element takes place.

It is particularly advantageous if a system according to the invention is used in combination with a method according to the invention and/or if a system according to the invention can be established by a method according to the invention.

BRIEF DESCRIPTION OF THE FIGURES

The invention will now be explained in greater detail on the basis of exemplary embodiments. The drawings are given by way of example and are intended to illustrate the concept of the invention but in no way to limit the scope thereof or depict it conclusively.

In the figures.

WAYS OF CARRYING OUT THE INVENTION

Figure 1:
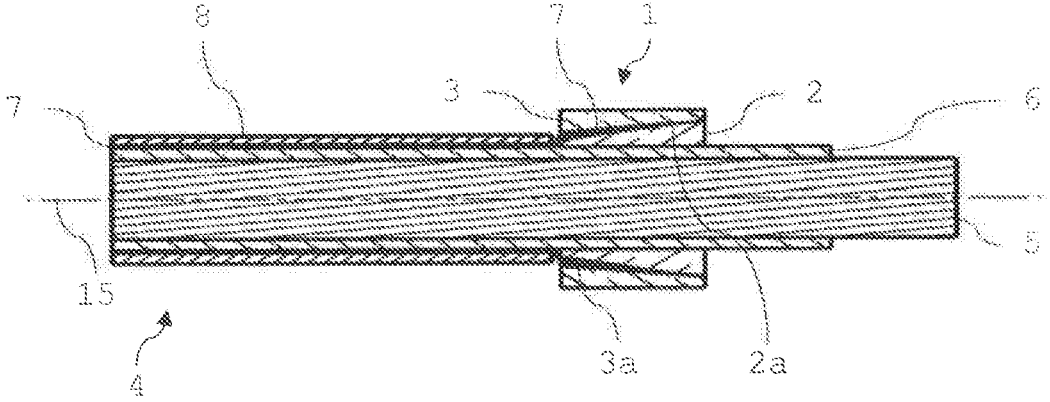
FIG. 1 shows a sectional view of a contact system according to the invention in a contact position.
Figure 2:
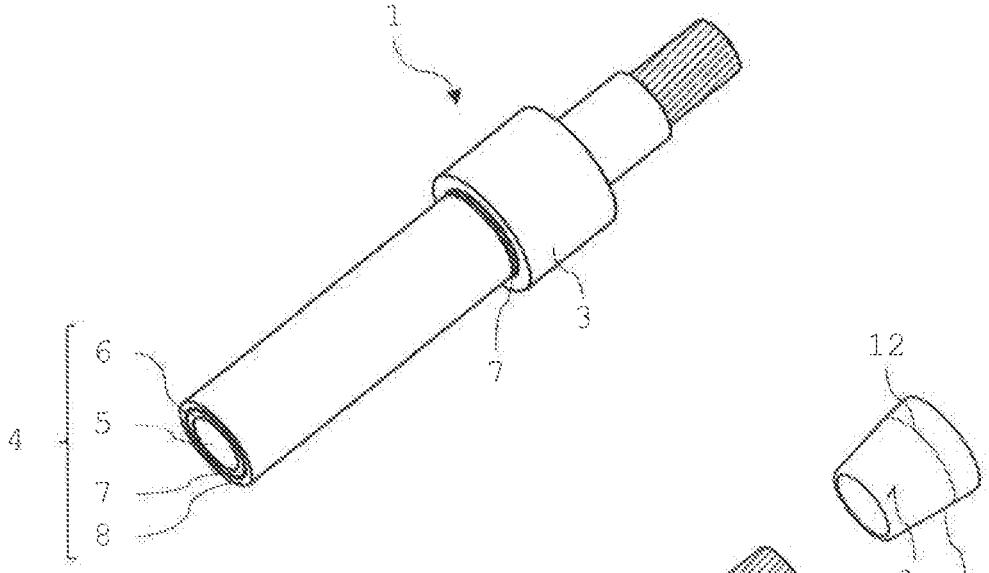
FIG. 2 shows an axonometric view of the contact system in the contact position.
Figure 4:
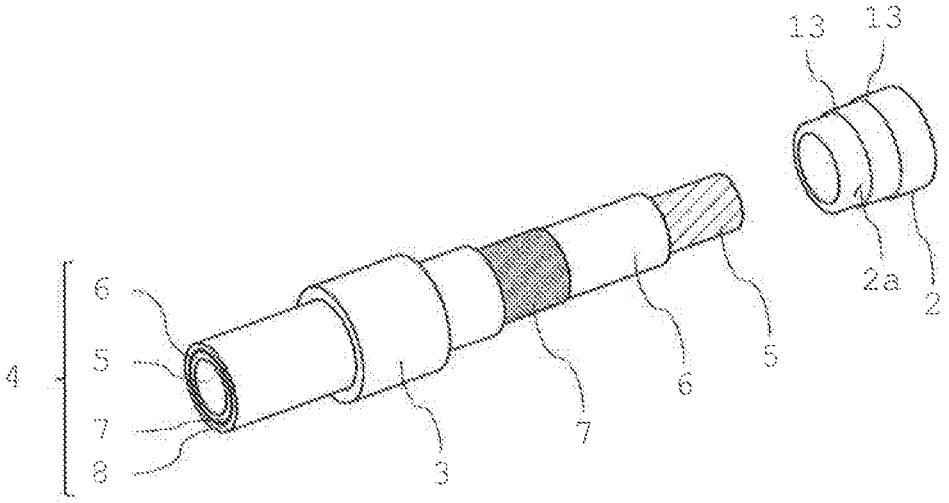
FIG. 4 shows an axonometric view of a second exemplary embodiment of the contact system in an intermediate position.

FIGS. 1 and 2 show the basic structure of a contact system according to the invention for contacting an aluminium braided shield 7 with a contact element 1. The aluminium braided shield 7 comprises a plurality of aluminium wires and extends between a primary insulation 6 and a secondary insulation 8 of an electrically conductive cable 4. The structure of the cable 4, which can be seen in particular in FIGS. 2 and 4, is as follows:

The core of the cable 4 is formed by an inner electrical conductor 5, which defines a conductor axis 15 that extends in a straight line in the figures. In the present figures, the inner conductor 5 is formed by a plurality of single conductors bundled as a strand and has a substantially circular cross-section. It goes without saying that the number of single conductors of a strand and also the number of strands and the geometry of the cross-section are irrelevant to the invention itself. By way of example, both single conductors and also elliptical or polygonal cross-sections of the inner conductor 5 are therefore conceivable in principle. A primary insulation 6, also referred to as the inner sheath or conductor insulation, is applied to the inner conductor 5 and brings about an insulation between the inner conductor 5 and the aluminium braided shield 7. A secondary insulation 8, also referred to as the outer sheath or cable sheath, is then applied to the aluminium braided shield 7 and insulates the inner conductor 5 and the aluminium braided shield 7 from the surrounding environment.

Before the aluminium braided shield 7 and the contact element 1 can be contacted, usually the electrically conductive cable 4 must be cut to length so that an open end of the cable 4 is formed. The secondary insulation 8 is removed in that region of the electrically conductive cable 4 in which the contact element 1 can be arranged in the contact position. This will hereinafter be referred to as the stripped region. The stripped region is usually arranged in the open end portion of the cable 4 and extends as far as the and of the cable 4, as can be seen in the figures. In addition, an end portion of the cable 4 may also be freed of primary insulation 6, aluminium braided shield 7 and secondary insulation 8, as can be seen in the figures, so that the inner conductor 5 is exposed for electrical connection.

The contact element 1 comprises an inner sleeve 2 having a first contact surface 2*a* and an outer sleeve 3 having a second contact surface 3*a*, wherein the contact surfaces 2*a*, 3*a* are designed to contact the aluminium braided shield 7 in the illustrated contact position. The inner sleeve 2 can be pushed at least in part into the outer sleeve 3. At least one of the two sleeves 2, 3 is designed as a contact sleeve and can be electrically connected to a ground for the purpose of potential equalization.

Since the contact surfaces 2*a*, 3*a* of the sleeves 2, 3 are designed such that the aluminium wires of the aluminium braided shield 7 are clamped between the contact surfaces 2*a*, 3*a* and contacted with the contact part 1 in the contact position of the contact part 1 as a result of the inner sleeve 2 and outer sleeve 3 being pushed one inside the other, the aluminium braided shield 7 is securely clamped between the contact surfaces 2*a*, 3*a* in the illustrated contact position. In addition, the contact surfaces 2*a*, 3*a* in the exemplary embodiments are also designed such that, in the contact position of the contact element 1, a pinching/shearing of the aluminium wires of the aluminium braided shield 7 and a cold welding of the aluminium wires of the aluminium braided shield 7 to the contact element 1 takes place as a result of the outer sleeve 3 and inner sleeve 2 being axially pressed together. This configuration is achieved in that the contact surfaces 2*a*, 3*a* have regions of different cross-section, in the present case of different diameter. The electrical connection between the aluminium wires of the aluminium braided shield 7 and the contact element 1 in the illustrated contact position is therefore established by means of cold welding. In other words, the aluminium wires are welded to the contact element 1 in the contact position.

In principle, due to the contact surfaces 2*a*, 3*a* surrounding the aluminium braided shield 7, in any case a uniform contacting of as far as possible all the aluminium wires is achieved without there being any need for radial compression, such as crimping, or for additional welding. The electrical contacting can be established simply by pushing and pressing the sleeves 2, 3 together.

Two possible geometric configurations of the contact surfaces 2*a*, 3*a* which achieve the two effects mentioned above will be discussed in detail below.

Figure 3:
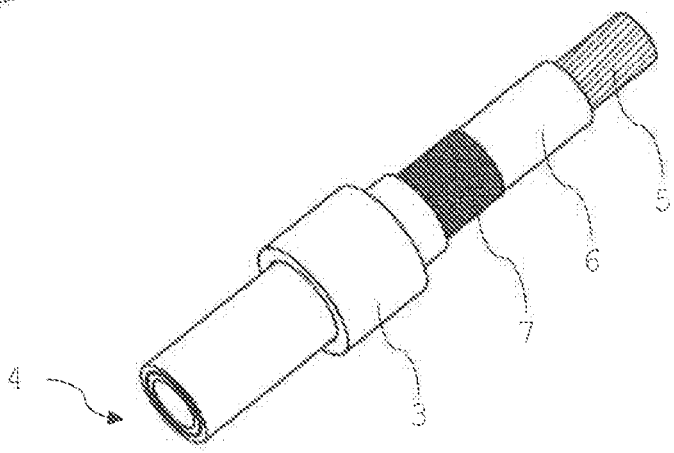
FIG. 3 shows an axonometric view of a first exemplary embodiment of the contact system in an intermediate position.

FIG. 3 shows an axonometric view of a first exemplary embodiment of the system according to the invention in an intermediate position, in which the contact surfaces 2*a*, 3*a* of the sleeves 2, 3 are not yet in contact with the aluminium braided shield 7. It can clearly be seen that the first contact surface 2*a* of the inner sleeve 2 is conical, so that the size of the cross-sections or diameters normal to the conductor axis 15 vary along the entire longitudinal extent of the sleeves 2, 3. In other words, the two contact surfaces 2*a*, 3*a* extend at an angle to the conductor axis 15. It can also be seen that the contact surface 2*a* has two sections of different slope, which merge into one another at a kink 12. The contact surface 2*a* has a larger opening angle, that is to say is steeper, in a first portion, which in the present figure faces towards the outer sleeve, than in the second portion.

FIG. 4 shows an axonometric view, analogous to FIG. 3, of a second exemplary embodiment of the system according to the invention in the intermediate position. It can be seen here that the first contact surface 2*a* of the inner sleeve 2 is composed of three cylindrical portions of differently sized cross-section or diameter, wherein two first steps 13 in each case separate two successive portions from one another.

Figure 5:
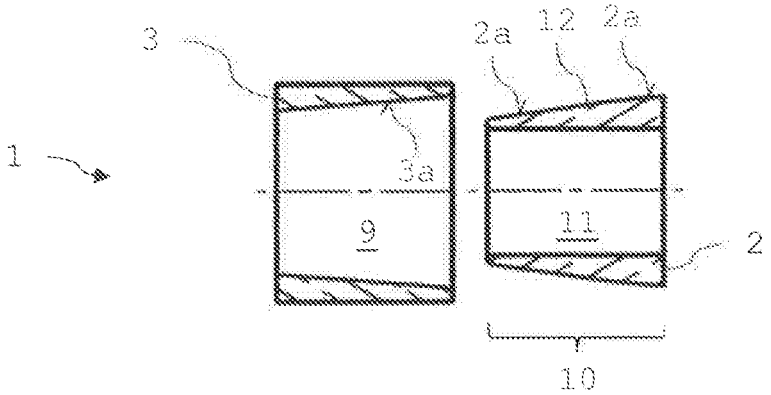
FIG. 5 shows an enlarged detail view of a contact element of the first exemplary embodiment.
Figure 6:
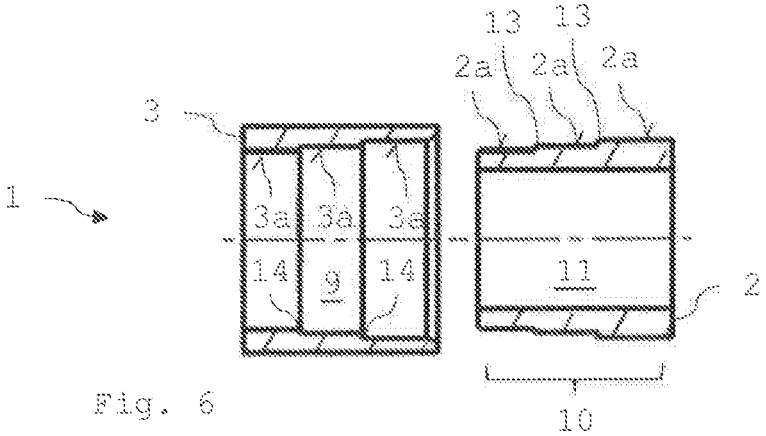
FIG. 6 shows an enlarged detail view of a contact element of a second exemplary embodiment.

FIG. 5 shows in detail a contact element 1 of the first exemplary embodiment and FIG. 6 shows in detail a contact element 1 of the second exemplary embodiment, that is to say in each case the inner sleeve 2 and the outer sleeve 3. It can clearly be seen that the inner sleeve 2 and the outer sleeve 3 each have a passage opening and that the inner sleeve 2 can be pushed at least in part into the outer sleeve 3. The passage opening of the inner sleeve 2 is designed as a cable bushing 11, through which the cable 4 can be passed. The first contact surface 2*a* of the inner sleeve 2 is formed by an outer circumferential surface of the inner sleeve 2.

The passage opening of the outer sleeve 3 is designed as an insertion volume 9 for receiving an insertable portion 10 of the inner sleeve 2 and additionally serves for the passage of the cable 4. In the present exemplary embodiment, the insertable portion 10 comprises the entire extent of the inner sleeve 2, so that the inner sleeve 2 in the contact position is entirely received in the outer sleeve 3. In alternative variant embodiments, it is also conceivable that the insertable portion 10 comprises only a part of the longitudinal extent of the inner sleeve 2, so that a part of the inner sleeve 2 protrudes out of the outer sleeve 3 in the contact position.

The second contact surface 3*a* is formed by an inner circumferential surface of the outer sleeve 3*a* and bounds the insertion volume 9.

In both exemplary embodiments, it can be seen that the geometry of the first contact surface 2*a* corresponds to that of the second contact surface 3*a* to the extent that the aluminium braided shield 7 can be clamped and/or cold-welded between the contact surfaces 2*a*, 3*a*.

FIG. 5 again shows the conicity of the first contact surface 2*a* together with the kink 12, as described above in connection with the first exemplary embodiment. In addition, the conical design of the second contact surface 3*a* of the outer sleeve 3 can now also be seen. In the present exemplary embodiment, the opening angles of the cones of the contact surfaces 2*a*, 3*a* differ from one another, so that a wedge-shaped cross-sectional narrowing is achieved when the inner sleeve 2 is pushed into the outer sleeve 3 or when the outer sleeve 3 is pushed onto the inner sleeve 2. The kink 12 defines that region in which a clamping force is exerted on the aluminium wires by the contact surfaces 2*a*, 3*a* and/or in which a pressure peak forms for pinching/shearing and cold welding the aluminium wires. The region is thus a circumferential contact edge defined by the kink.

FIG. 6 shows, in contrast, the first steps 13 of the first contact surface 2*a*, as described above in connection with the second variant embodiment. The second contact surface 3*a* is now also shown, which has second steps 14 which cooperate with the first steps 13 and which divides the second contact surface 3*a* into three portions. When the inner sleeve 2 is pushed into the outer sleeve 3 or when the outer sleeve 3 is pushed onto the inner sleeve 2, a wedge-shaped cross-sectional narrowing is once again achieved by the cooperation of the steps 13, 14. In other words, the steps 13, 14 define the region in which a clamping force is exerted on the aluminium wires by the contact surfaces 2*a*, 3*a* and/or in which a pressure peak forms for pinching/shearing and cold welding the aluminium wires. In this exemplary embodiment, each of the steps 13, 14 forms a circumferential contact edge which delineates the aforementioned region.

Figure 7A:
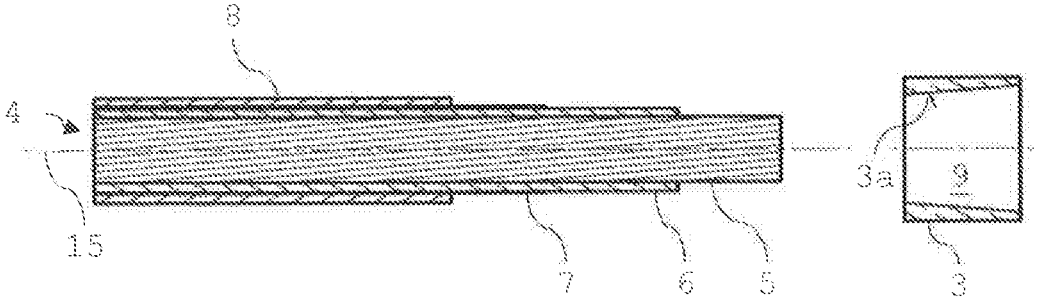
FIGS. 7*a,b,c,d* show sectional views of the first exemplary embodiment in several successive positions.
Figure 7B:
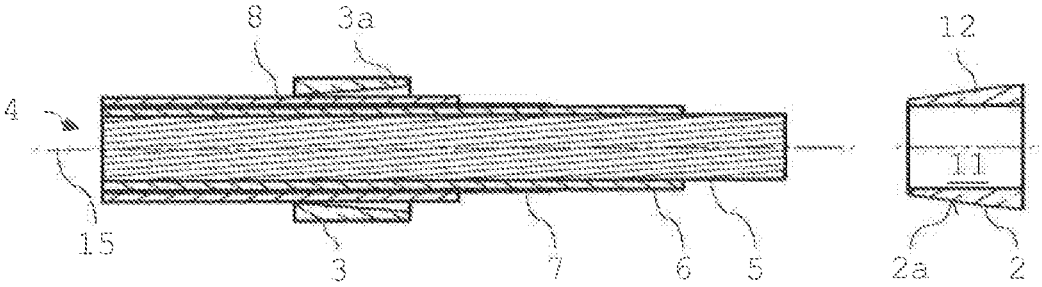

FIGS. 7*a,b,c,d* and 8*a,b,c,d* show different positions of the contact element 1 or of the inner sleeve 2 and the outer sleeve 3 during the contacting process, wherein the first-mentioned figures show a system according to the first exemplary embodiment and the last-mentioned figures show a system according to the second exemplary embodiment.

In a first step (which can be seen in FIGS. 7*a*, 7*b* and 8*a*, 8*b*), the outer sleeve 3 is in each case pushed onto the electrically conductive cable 4. The outer sleeve 3 is pushed beyond the stripped region, so that the outer sleeve 3 comes to rest over the secondary insulation 8. In order to be able to ensure that the outer sleeve 3 can be pushed onto the secondary insulation 8, the smallest diameter of the passage opening of the outer sleeve is larger than or equal to the diameter of the cable 4 together with the secondary insulation 8. In other words, the cable 4 is in part received in the insertion volume 9 of the outer sleeve 3.

The second step (which is shown in FIGS. 7*b*, 7*c* and 8*b*, 8*c*) consists in that the inner sleeve 2 is pushed onto the electrically conductive cable 4. The smallest diameter of the cable bushing 11 is larger than or equal to the diameter of the cable 4 together with the primary insulation 6, so that the inner sleeve 2 can be pushed onto the primary insulation 6.

Figure 7C:
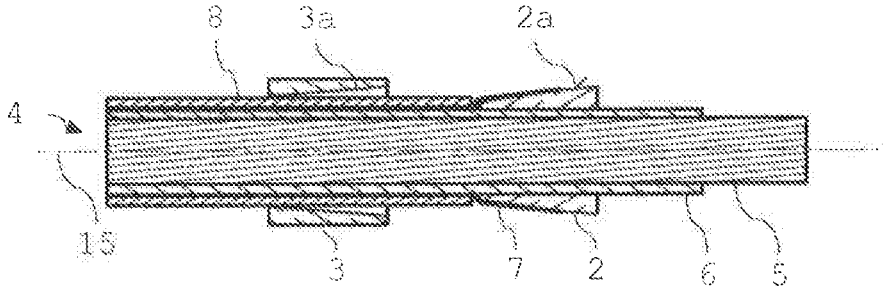
Figure 7D:
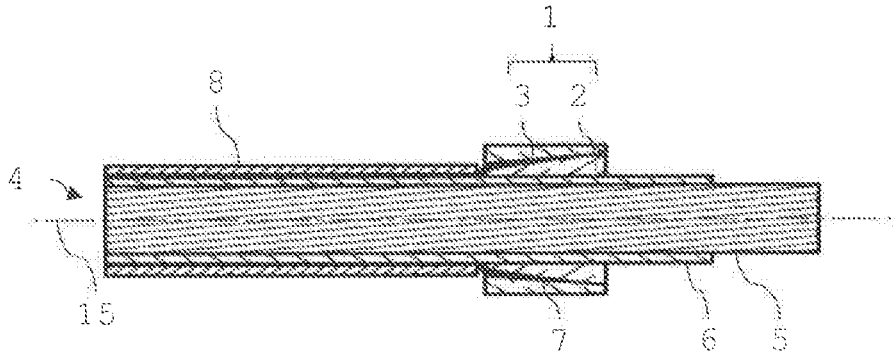
Figure 8A:
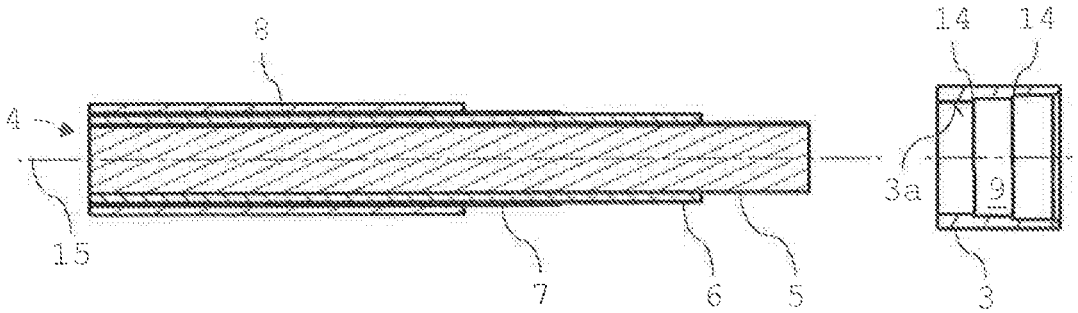
FIGS. 8*a,b,c,d* show sectional views of the second exemplary embodiment in several successive positions.
Figure 8B:
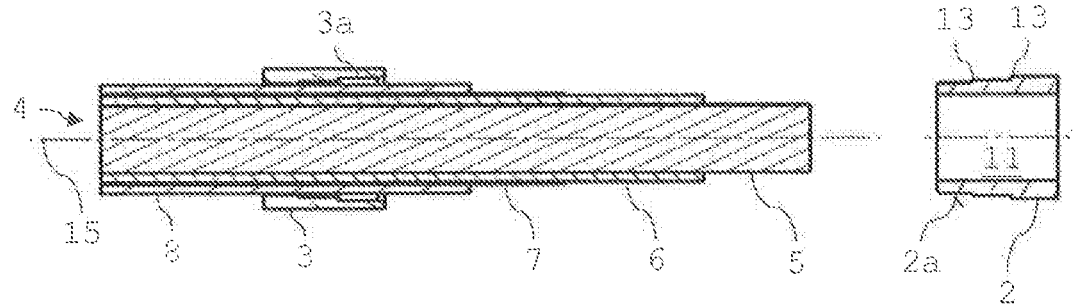
Figure 8C:
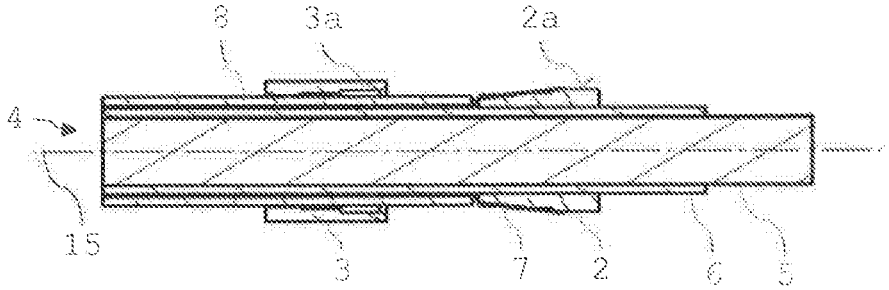
Figure 8D:
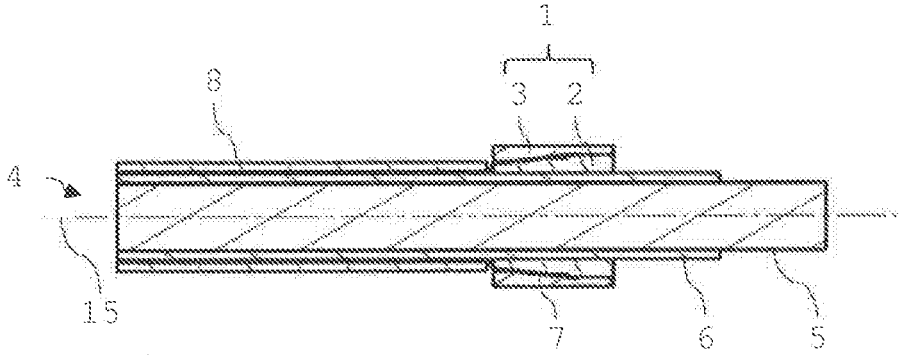

As can be seen in FIGS. 7*c* and 8*c*, the inner sleeve 2 is pushed in between the primary insulation 6 and the aluminium braided shield 7, so that the aluminium braided shield 7 contacts the first contact surface 2*a*. It is also conceivable that the aluminium braided shield 7 is lifted away from the primary insulation 6 in a separate step and, once the inner sleeve 2 has been pushed on, is folded over the first contact surface 2*a*, for example by means of the step described below or in a separate step.

In the last step, the outer sleeve 3 is then displaced in the direction of the inner sleeve 2 until, in the contact position, the second contact surface 3*a* and the first contact surface 2*a* contact the aluminium braided shield 7 and the aluminium wires of the aluminium braided shield 7 are clamped between the contact surfaces 2*a*, 3*a* and the electrical contact is established between the contact element 1 and the aluminium braided shield 7. In the first exemplary embodiment the wedge-shaped taper or kink 12 and in the second exemplary embodiment the steps 13, 14 define that region of the contact surfaces 2*a*, 3*a* in which the clamping force is exerted on the aluminium braided shield 7 in the contact position.

As the inner sleeve 2 and the outer sleeve 3 are further pressed together, pressure peaks form at the kink 12 or at the steps 13, 14 (that is to say at the circumferential contact edges), which pressure peaks lead first to a compression and, as the pressing-together continues, to an at least partial pinching and/or shearing, preferably to a complete shearing-off, of the aluminium wires, so that a cold welding of the aluminium wires of the aluminium braided shield 7 to the contact element 1 takes place. By virtue of the pinching and/or shearing of the aluminium wires, the surface of the aluminium wires that has the oxide layer is broken open and thus the oxide layer is penetrated and the oxide layer is prevented from forming again, so that an electrical connection which is highly conductive and which is resistant to temperature changes is ensured between the aluminium braided shield 7 and the contact element 1 if the aluminium wires, after the pressing-together, are cold-welded to the contact element 1 in the contact position.

Usually one of the two sleeves 2, 3, that is to say either the inner sleeve 2 or the outer sleeve 3, is designed as a contact sleeve which is manufactured from copper or a copper alloy and preferably has a corrosion-inhibiting coating, for instance made of nickel and/or tin or alloys thereof. By way of this contact sleeve, the potential equalization of the aluminium braided shield 7 with a ground is possible since the contact sleeve can be electrically connected to the ground by means of an equalizing conductor. The respective other sleeve is designed as a support sleeve and is manufactured from aluminium or an aluminium alloy in order to reduce the corrosion of the aluminium wires.

It goes without saying that any combinations of the first and second exemplary embodiment are also suitable for achieving the same technical effects. In addition, geometries differing from the geometry of the contact surfaces 2*a*, 3*a* shown in the exemplary embodiments are conceivable if they enable a clamping and/or compression/shearing-off of the aluminium wires of the aluminium braided shield 7.

Figure 9:
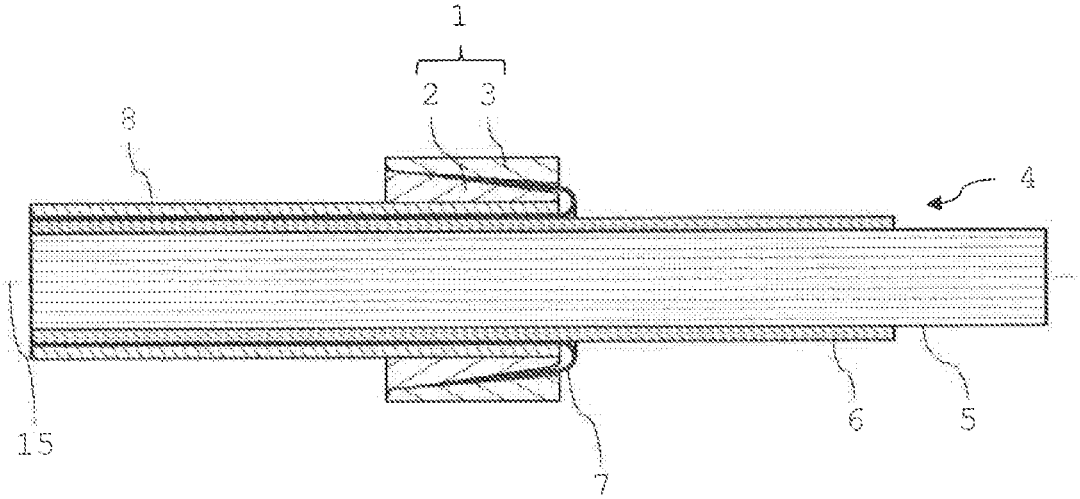
FIG. 9 shows a sectional view of a third exemplary embodiment of the contact system in the contact position.

FIG. 9 shows a third exemplary embodiment of the contact system according to the invention, in which the inner sleeve 2 in the contact position is seated on the secondary insulation 8. In order to be able to clamp the aluminium braided shield 7 between the contact surfaces 2*a*, 3*a*, a portion of the aluminium braided shield 7 is folded back over the first contact surface 2*a*. The outer sleeve 3 can be pushed onto the inner sleeve 2 in the axial direction, that is to say in the direction of the conductor axis 15, in order to enable the clamping and/or compression/shearing-off of the aluminium wires of the aluminium braided shield 7 between the two contact surfaces 2*a*, 3*a*.

The method for contacting the aluminium braided shield 7 with the contact element 1 differs from the methods described above connection with the first two variant embodiments on account of the different structure of the contact systems: In a first step, the inner sleeve 2 is pushed onto the open end of the electrically conductive cable 4 and is pushed onto the secondary insulation 8 beyond the stripped region. If the first contact surface 2*a*—as in the illustrated exemplary embodiment—has regions with a differently sized cross-section, it is advantageous if the region having the smallest cross-section is directed towards the open end of the cable 4. In the present exemplary embodiment, the contact surfaces 2*a*, 3*a* are conical as in the first and fourth exemplary embodiment, but it is also conceivable that the contact surfaces 2*a*, 3*a* have steps in a manner analogous to the second exemplary embodiment, or a combination of slopes and steps. In the present exemplary embodiment, the inner sleeve 2 ends flush with the secondary insulation 8, but an offset to the left or to the right is also conceivable. Thereafter, a portion of the aluminium braided shield 7 that has been exposed as a result of the stripping is folded over the first contact surface 2*a*, so that the aluminium braided shield 7 is folded back and rests on the first contact surface 2*a*. In the last step, the outer sleeve 3 is then displaced from the direction of the open end of the cable 4 in the direction of the inner sleeve 2, so that the aluminium braided shield 7 is first clamped between the contact surfaces 2*a*, 3*a* and then is compressed or sheared off and cold welded as a result of said sleeves being axially pressed together further. By virtue of such a configuration, conventional methods, in which the aluminium braided shield 7 is folded over, can easily be combined with the clamping and cold welding that is advantageous for aluminium, by pushing the sleeves 2, 3 one inside the other and pressing them together.

Figure 10:
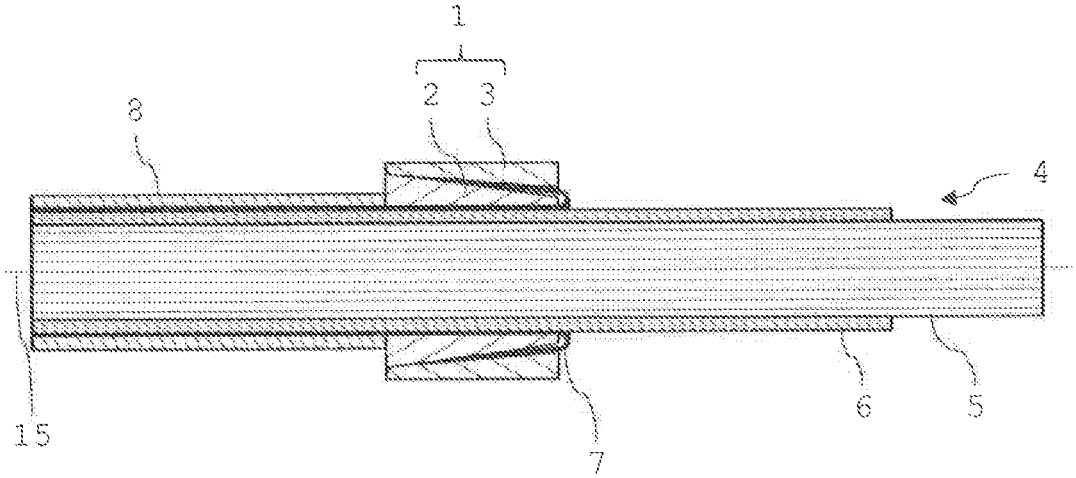
FIG. 10 shows a sectional view of a fourth exemplary embodiment of the contact system in the contact position.

FIG. 10 shows a fourth exemplary embodiment of the contact system according to the invention, which is constructed in a manner similar to the third exemplary embodiment described above. Here, in contrast to the previously described exemplary embodiment, the inner sleeve 2 in the contact position is seated not on the secondary insulation 8, but instead on an exposed portion of the aluminium braided shield 7. The aluminium braided shield 7 is thus exposed or stripped over a larger region than the region in which it is folded over.

The method for contacting the aluminium braided shield 7 is carried out in a manner analogous to the method described above, wherein the inner sleeve 2 is simply pushed onto the exposed portion of the aluminium braided shield 7 and the portion of the aluminium braided shield 7 that projects beyond the inner sleeve 2 is folded over the first contact surface 2*a*. The outer sleeve 3 is pushed on in the manner described above. Such a configuration enables a particularly space-saving arrangement of the contact element 1 in the contact position. Only by pushing the sleeves 2, 3 one inside the other and by pressing them together in the manner according to the invention in order to establish the contacting is it possible for the inner sleeve 2 to rest on the aluminium braided shield 7, since the aluminium braided shield 7 located below the inner sleeve 2 could be damaged in the case of conventional radial pressing operations. In addition to this, the secondary insulation 8 can be used as a stop for the positioning of the inner sleeve 2.

LIST OF REFERENCE SIGNS

1 contact element
2 inner sleeve
2*a* first contact surface
3 outer sleeve
3*a* second contact surface
4 electrically conductive cable
5 inner conductor
6 primary insulation
7 aluminium braided shield
8 secondary insulation
9 insertion volume
10 insertable portion
11 cable bashing
12 kink
13 first step
14 second step
15 conductor axis

The invention claimed is:

1. A contact system for electrically contacting an aluminum braided shield with a contact element, comprising an electrically conductive cable having an inner electrical conductor, a primary insulation surrounding the inner electrical conductor, and a secondary insulation surrounding the primary insulation;

the aluminum braided shield which comprises aluminum wires and which is arranged so as to extend at least in part between the primary insulation and the secondary insulation of the electrically conductive cable;

the contact element, which is pushable onto the electrically conductive cable, comprises an outer sleeve and an inner sleeve, the inner sleeve being pushable at least in part into the outer sleeve, wherein the inner sleeve has a first contact surface and the outer sleeve has a second contact surface for contacting the aluminum braided shield, wherein at least one of:

the first contact surface has regions of differently sized cross-sections that change along a longitudinal axis of the inner sleeve, which corresponds with a longitudinal conductor axis of the inner electrical conductor when the inner sleeve is pushed onto the electrically conductive cable, or the second contact surface has regions of differently sized cross-sections that change along a longitudinal axis of the outer sleeve, which corresponds with the longitudinal conductor axis of the inner electrical conductor when the outer sleeve is pushed onto the electrically conductive cable, wherein the first and second contact surfaces are designed such that, in a contact position of the contact element, the aluminum wires of the aluminum braided shield are clamped between the first and second contact surfaces in a way that the first contact surface contacts a first surface of the aluminum wires and the second contact surface contacts a second surface of the aluminum wires that is opposite the first surface of the aluminum wires, and wherein the aluminum wires of the aluminum braided shield are electrically contacted with the contact element by axially pushing together the inner sleeve and the outer sleeve one inside the other.

2. The contact system according to claim 1, wherein the first and second contact surfaces are additionally designed such that, in the contact position of the contact element, by the axially pushing together of the outer sleeve and the inner sleeve, the aluminum wires of the aluminum braided shield are pinched/sheared and the aluminum wires of the aluminum braided shield are cold-welded to the contact element.

3. The contact system according to claim 1, wherein the second contact surface on an inside of the outer sleeve bounds an insertion volume, and the first contact surface on an outside of the inner sleeve is formed by an insertable portion of the inner sleeve, so that the insertable portion of the inner sleeve is insertable into the insertion volume of the outer sleeve.

4. The contact system according to claim 3, wherein the insertion volume of the outer sleeve or the insertable portion of the inner sleeve taper at least in part with respect to the longitudinal conductor axis, when the contact element is pushed onto the electrically conductive cable.

5. The contact system according to claim 3, wherein the inner sleeve is entirely received in the insertion volume of the outer sleeve in the contact position.

6. The contact system according to claim 1, wherein at least one of the first and/or the second contact surface is designed to extend at least in part at an angle to the longitudinal conductor axis in the contact position, when the contact element is pushed onto the electrically conductive cable.

7. The contact system according to claim 1, wherein at least one of the first and/or the second contact surface is conical.

8. The contact system according to claim 1, wherein the first and the second contact surface are conical, and wherein opening angles of at least parts of the conical surfaces of the first and the second contact surfaces are of different sizes in order to define a region between the first and the second contact surface in which, when the inner sleeve and the outer sleeve are axially pushed together axially one inside the other, a pressure peak is formed for clamping the aluminum braided shield.

9. The contact system according to claim 7, wherein at least one of the first or the second contact surface has at least one kink.

10. The contact system according to claim 1, wherein the first and the second contact surfaces each have at least one step.

11. The contact system according to claim 1, wherein the first contact surface has at least one first step and the second contact surface has at least one second step, wherein the first and second steps each form a circumferential contact edge and the aluminum braided shield is contacted by the contact edges in the contact position.

12. The contact system according to claim 1, wherein at least one of the inner sleeve or the outer sleeve is manufactured from copper or a copper alloy.

13. The contact system according to claim 1, wherein one of the inner or outer sleeves is manufactured from copper or a copper alloy, and a respective other of the sleeves is manufactured from aluminum or an aluminum alloy.

14. The contact system according to claim 12, wherein the at least one of the inner or outer sleeve manufactured from copper or a copper alloy has a corrosion-inhibiting coating.

15. The contact system according claim 1, wherein the secondary insulation is removed at least in that region of the electrically conductive cable in which the contact element is arranged in the contact position, wherein the region having the smallest cross-section of the first contact surface adjoins the region of the cable having the secondary insulation.

16. The contact system according to claim 1, wherein the inner sleeve in the contact position is arranged between the primary insulation and the aluminum braided shield.

17. The contact system according to claim 1, wherein the aluminum braided shield is folded over the first contact surface of the inner sleeve and a cable bushing of the inner sleeve contacts the secondary insulation or the aluminum braided shield.

18. The contact system according to claim 9, wherein each kink forms a circumferential contact edge in order to define a region between the first and the second contact surface in which, when the inner sleeve and the outer sleeve are axially pushed together one inside the other, a pressure peak is formed for clamping the aluminum braided shield, and wherein the aluminum braided shield is contacted by the contact edges in the contact position.

19. The contact system according to claim 10, wherein each step forms a circumferential contact edge in order to define a region between the first and the second contact surface in which, when the inner sleeve and the outer sleeve are axially pushed together one inside the other, a pressure peak is formed for clamping the aluminum braided shield, and wherein the aluminum braided shield is contacted by the contact edges in the contact position.

* * * * *